US010003148B2

(12) United States Patent
Ashibu et al.

(10) Patent No.: US 10,003,148 B2
(45) Date of Patent: Jun. 19, 2018

(54) CONNECTOR

(71) Applicant: Japan Aviation Electronics Industry, Limited, Tokyo (JP)

(72) Inventors: Kenta Ashibu, Tokyo (JP); Hiroaki Obikane, Tokyo (JP); Takayuki Nishimura, Tokyo (JP); Akihiro Matsunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days. days.

(21) Appl. No.: 15/701,744

(22) Filed: Sep. 12, 2017

(65) Prior Publication Data

US 2018/0138624 A1 May 17, 2018

(30) Foreign Application Priority Data

Nov. 11, 2016 (JP) ..... 2016-220535

(51) Int. Cl.
*H01R 13/24* (2006.01)
*H01R 12/71* (2011.01)

(52) U.S. Cl.
CPC ..... *H01R 13/2407* (2013.01); *H01R 12/716* (2013.01); *H01R 13/2492* (2013.01)

(58) Field of Classification Search
CPC ..... H01R 13/2407; H01R 12/716; H01R 13/2492
USPC ..... 439/660
See application file for complete search history.

(56) References Cited

U.S. PATENT DOCUMENTS 7,410,364 B2 * 8/2008 Kishi ..... H01R 12/716 439/566
7,722,408 B2 * 5/2010 Miyazaki ..... H01R 13/516 439/570
7,736,177 B2 * 6/2010 Tsai ..... H01R 12/57 439/570
8,562,379 B2 * 10/2013 Miyazaki ..... H01R 12/716 439/660
9,124,011 B2 * 9/2015 Miyazaki ..... H01R 12/716
9,203,172 B2 * 12/2015 Kubo ..... H01R 12/73
9,236,672 B2 * 1/2016 Kuninaka ..... H01R 12/712
9,331,410 B2 * 5/2016 Obikane ..... H01R 13/02
(Continued)

FOREIGN PATENT DOCUMENTS

JP 2015-122189 A 7/2015
JP 5805288 B2 11/2015

*Primary Examiner* — Alexander Gilman
(74) *Attorney, Agent, or Firm* — Collard & Roe, P.C.

(57) ABSTRACT

A connector is mountable on an object in an upper-lower direction and mateable with a mating connector along the upper-lower direction. The connector comprises a housing and an additional member held by the housing. The housing has a receiving portion for receiving the mating connector. The additional member has a fixed portion fixed to an object, a base portion which extends upward from the fixed portion and is located outside the receiving portion in a lateral direction, an armor portion extending inward from the base portion in the lateral direction, a spring portion extending from the base portion and a projection which is supported by the spring portion and projects inward in the lateral direction. The extending of the spring portion from the base portion starts at a starting portion which is nearer to the fixed portion than to the innermost part of the armor portion.

7 Claims, 8 Drawing Sheets

(56) References Cited

U.S. PATENT DOCUMENTS

| | | | | |
|---|---|---|---|---|
| 9,350,095 | B2 * | 5/2016 | Arichika | H01R 13/6271 |
| 9,362,637 | B2 * | 6/2016 | Hasegawa | H01R 12/716 |
| 9,391,398 | B2 * | 7/2016 | Omodachi | H01R 12/707 |
| 9,397,423 | B2 * | 7/2016 | Suzuki | H01R 12/716 |
| 9,484,648 | B2 * | 11/2016 | Takenaga | H01R 12/716 |
| 9,543,675 | B1 * | 1/2017 | Takenaga | H01R 12/716 |
| 9,647,361 | B2 * | 5/2017 | Kobuchi | H01R 12/707 |
| 9,666,963 | B2 * | 5/2017 | He | H01R 12/7088 |
| 9,705,223 | B2 * | 7/2017 | Miyazaki | H01R 12/707 |
| 9,831,576 | B2 * | 11/2017 | Wu | H01R 12/73 |
| 9,887,473 | B2 * | 2/2018 | Lee | H01R 12/716 |
| 9,899,771 | B2 * | 2/2018 | Ashibu | H01R 13/631 |
| 2010/0068900 | A1 * | 3/2010 | Wu | H01R 12/716 439/74 |
| 2011/0263140 | A1 * | 10/2011 | Sato | H01R 12/7052 439/74 |
| 2013/0012039 | A1 * | 1/2013 | Nose | H01R 12/716 439/74 |
| 2013/0280926 | A1 * | 10/2013 | Ono | H01R 12/712 439/65 |
| 2013/0316598 | A1 * | 11/2013 | Yoshioka | H01R 12/7029 439/733.1 |
| 2013/0330943 | A1 * | 12/2013 | Sasaki | H01R 13/631 439/74 |
| 2014/0227899 | A1 * | 8/2014 | Tanaka | H01R 13/631 439/357 |
| 2014/0227910 | A1 * | 8/2014 | Tanaka | H01R 12/7052 439/626 |
| 2014/0273587 | A1 * | 9/2014 | Takenaga | H01R 13/20 439/345 |

* cited by examiner

CONNECTOR

CROSS REFERENCE TO RELATED APPLICATIONS

This application is based on and claims priority under 35 U.S.C. § 119 to Japanese Patent Application No. JP2016-220535 filed Nov. 11, 2016, the content of which is incorporated herein in its entirety by reference.

BACKGROUND OF THE INVENTION

This invention relates to a connector which is connectable to a mating connector at a projection supported by a spring portion.

For example, this type of connector is disclosed in JP 2015-122189A (Patent Document 1), the content of which is incorporated herein by reference.

Referring to FIG. 16, Patent Document 1 discloses a connector (not shown) which comprises a power terminal (additional member) 90 attached to a housing (not shown). The additional member 90 has regulation portions (armor portions) 910, resilient arms (spring portions) 920 and contact portions (projections) 930. The spring portions 920 extend from the armor portions 910, respectively, and the projections 930 are supported by the spring portions 920 to be movable, respectively. The connector is mateable with a mating connector (not shown) along an upper-lower direction (Z-direction). The mating connector comprises a power terminal 98 which has attached portions 982. When the connector and the mating connector are mated with each other, the power terminal 98 is received within the additional member 90, and the attached portions 982 are brought into contact with the projections 930, respectively. Thus, the connector is connectable to the mating connector at the projections 930 which are supported by the spring portions 920, respectively.

According to the invention disclosed in Patent Document 1, in the mating process of the connector with the mating connector, the mating connector might be brought into abutment with the armor 910 so that the armor 910 is pressed to be deformed. When the armor 910 is deformed, the spring portion 920 and the projection 930 may be moved, and the power terminal 98 may not be brought into contact with the projection 930 as designed. Thus, connection reliability between the connector and the mating connector might be lowered.

SUMMARY OF THE INVENTION

It is therefore an object of the present invention to provide a connector which facilitates to improve connection reliability between the connector and a mating connector.

An aspect of the present invention provides a connector mountable on an object in an upper-lower direction and mateable with a mating connector along the upper-lower direction. The connector comprises a housing, terminals and an additional member. The terminals and the additional member are held by the housing. The housing has a receiving portion. The receiving portion partially receives the mating connector under a mated state where the connector is mated with the mating connector. The additional member has a fixed portion, a base portion, an armor portion, a spring portion and a projection. The fixed portion is fixed to the object when the connector is used. The base portion extends upward from the fixed portion and is located outside the receiving portion in a lateral direction perpendicular to the upper-lower direction. The armor portion extends inward from the base portion in the lateral direction. The spring portion extends from the base portion. The projection is supported by the spring portion and projects inward in the lateral direction. When the additional member is seen from above along the upper-lower direction, the spring portion is, at least in part, covered by the armor portion, and the projection is, at least in part, located in the receiving portion to be visible. The spring portion has a starting portion at which the spring portion starts to extend from the base portion and which is nearer to the fixed portion than to an innermost part of the armor portion that is located to be innermost in the lateral direction.

According to an aspect of the present invention, the projection is supported by the spring portion. When the additional member is seen from above along the upper-lower direction, at least a part of the projection is visibly located in the receiving portion which partially receives the mating connector. The thus-formed projection can be uses, for example, as a contact portion that is brought into contact with and electrically connected with the mating connector or as an engaged portion that is engaged with the mating connector. Thus, the connector according to an aspect of the present invention is connectable to the mating connector at the projection supported by the spring portion.

According to an aspect of the present invention, the starting portion is nearer to the fixed portion than to the innermost part, wherein the spring portion starts to extend from the base portion at the starting portion, the fixed portion is to be fixed to the object, the innermost part is of the armor portion and is located to be innermost in the lateral direction, and the armor portion covers, at least in part, the spring portion. According to this arrangement, the starting portion is close to the fixed portion and is not generally moved even when the armor portion is pressed and deformed by the mating connector. Therefore, the spring portion extending from the starting portion and the projection supported by the spring portion are hardly moved. Thus, the connector according to an aspect of the present invention facilitates to improve connection reliability of the projection with the mating connector.

An appreciation of the objectives of the present invention and a more complete understanding of its structure may be had by studying the following description of the preferred embodiment and by referring to the accompanying drawings.

Figure 1:
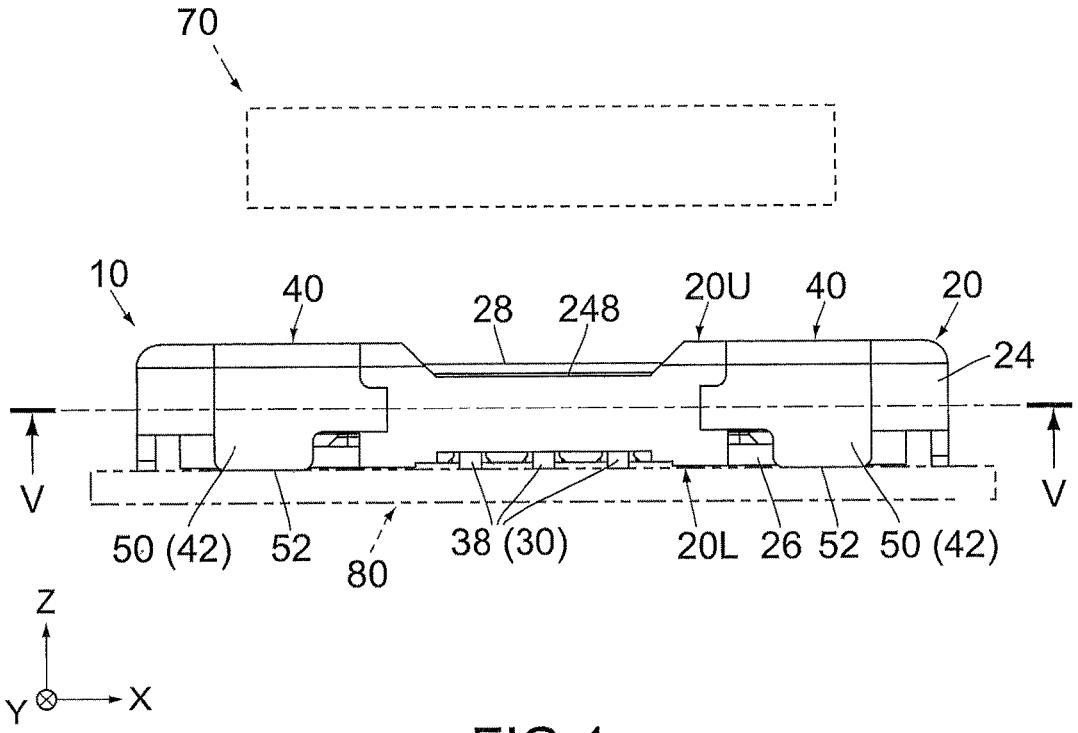
FIG. 1 is a side view showing a connector according to an embodiment of the present invention, wherein an outline of a mating connector is illustrated in dashed-line, and another outline of a circuit board on which the connector is mounted is illustrated in two-dot chain line.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
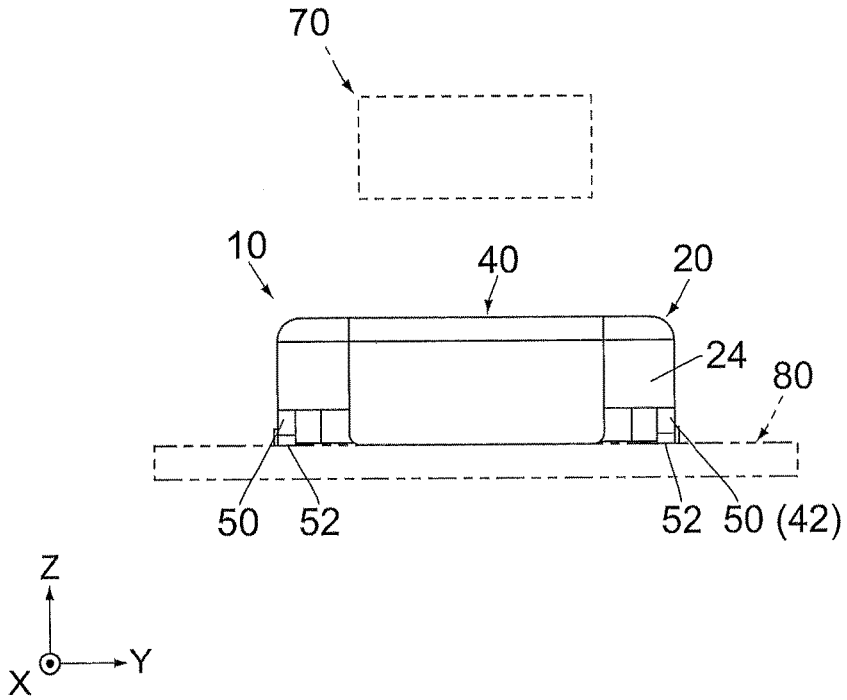
FIG. 2 is a front view showing the connector of FIG. 1, wherein an outline of the mating connector is illustrated in dashed-line, and another outline of the circuit board is illustrated in two-dot chain line.

Referring to FIGS. 1 and 2, a connector 10 according to an embodiment of the present invention is mountable on an object (circuit board) 80 in an upper-lower direction (Z-direction). In other words, the connector 10 is an on-board connector that is mounted on the circuit board 80 when used. Moreover, the connector 10 is mateable with a mating connector 70 along the Z-direction (mating direction). Under a mated state where the connector 10 is mated with the mating connector 70, the connector 10 is electrically connected with the mating connector 70 so that the mating connector 70 is electrically connected with the circuit board 80.

Figure 3:
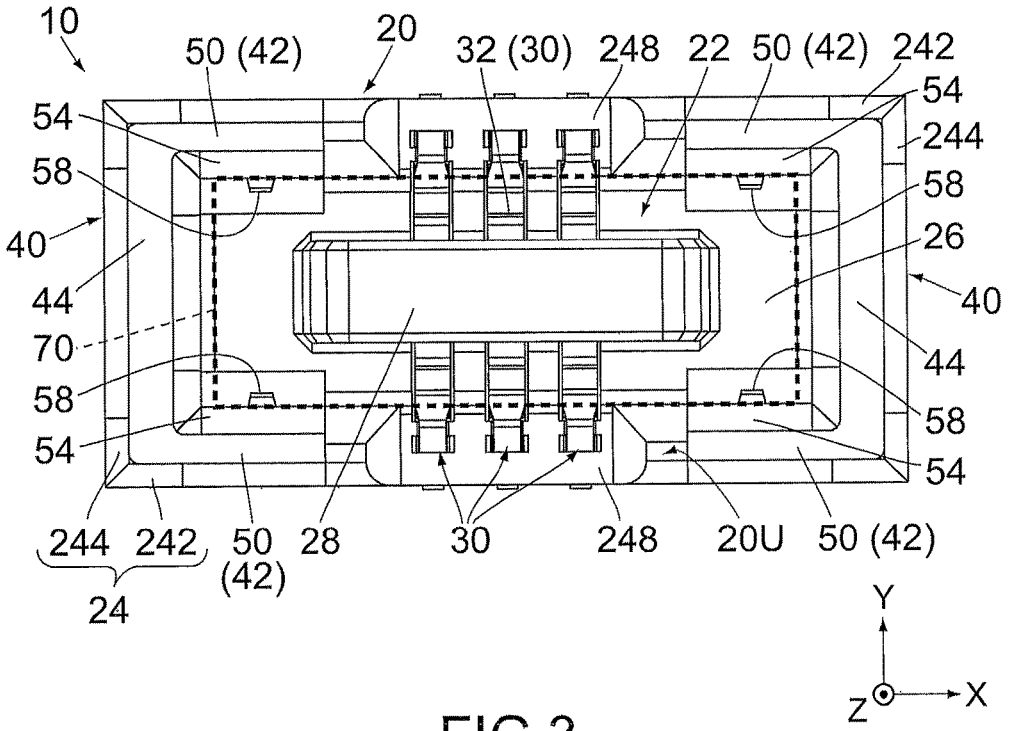
FIG. 3 is a plan view showing the connector of FIG. 1, wherein an outline of the mating connector is illustrated in dashed-line.

Referring to FIG. 3, the connector 10 according to the present embodiment is a receptacle which partially receives a plug, or the mating connector 70, under the mated state. However, the present invention is not limited thereto but applicable to a plug. In other words, the connector 10 may be a plug.

Referring to FIGS. 1 to 4, the connector 10 comprises a housing 20 made of insulator such as resin, terminals 30 each made of conductor such as metal and two additional members 40 each made of bendable material such as metal.

Figure 4:
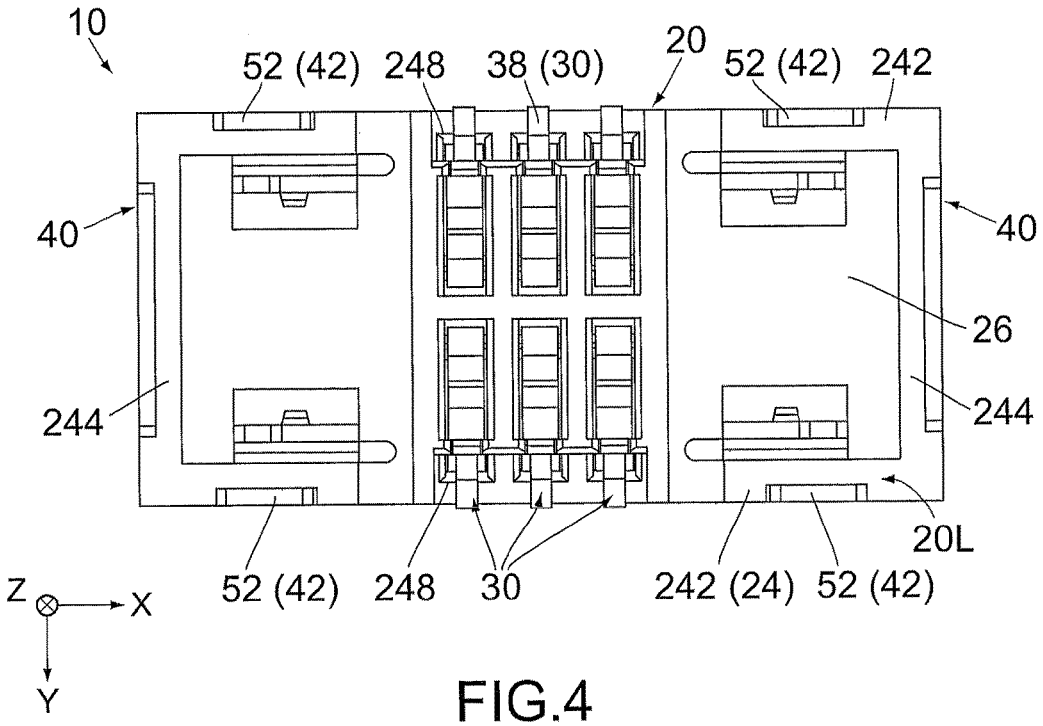
FIG. 4 is a bottom view showing the connector of FIG. 1.
Figure 5:
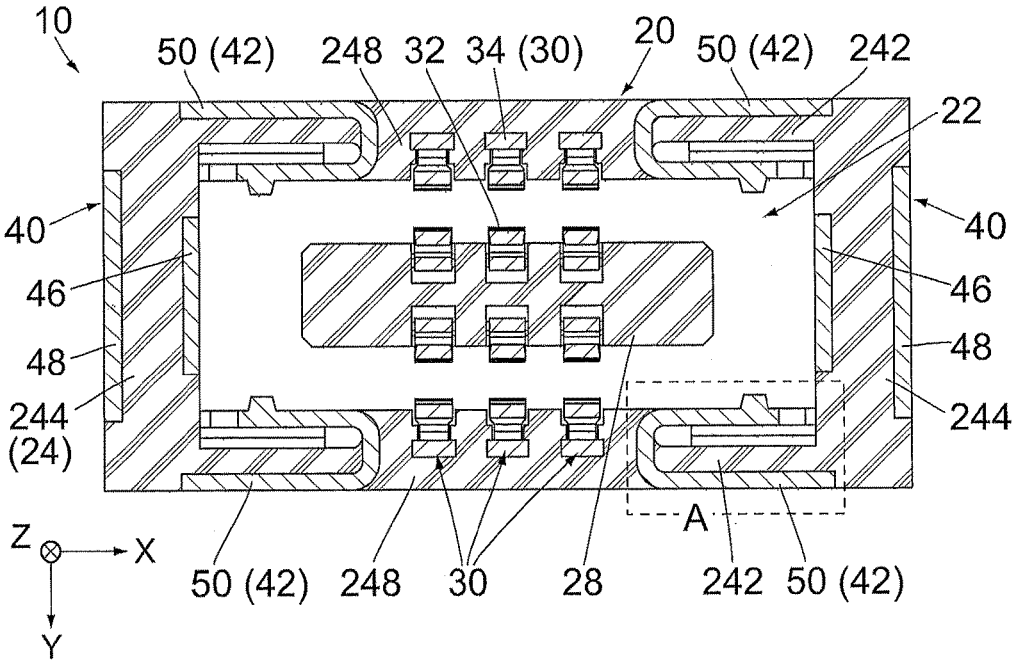
FIG. 5 is a cross-sectional view showing the connector of FIG. 1, taken along line V-V.

As shown in FIGS. 3 to 5, the housing 20 has an outer wall 24, a bottom wall 26 and a projecting portion 28. The outer wall 24 has a rectangular frame-shape in the XY-plane. In detail, the outer wall 24 has two sidewalls 242 and two coupling walls 244. Each of the sidewalls 242 extends along a front-rear direction (X-direction) to have ends in the X-direction. Each of the coupling walls 244 extends along a lateral direction (Y-direction) and couples the ends of the two sidewalls 242 to each other in the X-direction. The bottom wall 26 is located at a lower end, or the negative Z-side end, of the housing 20. The projecting portion 28 is located at the middle part of the housing 20 in the XY-plane and projects upward, or in the positive Z-direction, from the bottom wall 26.

Referring to FIG. 5, each of the sidewalls 242 has a holding portion 248 for holding the terminals 30. The holding portion 248 is formed in the middle part of the sidewall 242 in the X-direction.

As shown in FIG. 3, the housing 20 has a receiving portion 22. The receiving portion 22 is a space formed between the outer wall 24 and the projecting portion 28. The receiving portion 22 partially receives the mating connector 70 under the mated state.

Referring to FIG. 1, the housing 20, which is formed as described above, has an upper surface 20U and a lower surface 20L. The upper surface 20U is located at an upper end, or the positive Z-side end, of the connector 10, and the lower surface 20L is located at a lower end of the connector 10. In the present embodiment, the upper surface 20U is an upper surface of the outer wall 24, and the lower surface 20L is a lower surface of the outer wall 24.

Referring to FIGS. 3 to 5, the number of the terminals 30 in the present embodiment is six. Each of the terminals 30 is a signal terminal and has a contact portion 32, a held portion 34 and a fixed portion 38. Each of the terminals 30 is held by the housing 20. Referring to FIG. 5, the held portions 34 of three of the terminals 30 are held by the holding portion 248 of the positive Y-side sidewall 242, and the held portions 34 of remaining three of the terminals 30 are held by the holding portion 248 of the negative Y-side sidewall 242.

Referring to FIGS. 3 and 5, in each of the terminals 30, the contact portion 32 extends from the held portion 34 to the inside of the projecting portion 28 and subsequently extends upward while partially projecting to the inside of the receiving portion 22. Each of the contact portions 32 is brought into contact with a corresponding mating signal terminal (not shown) of the mating connector 70 under the mated state so that the connector 10 and the mating connector 70 are electrically connected with each other.

Referring to FIG. 4, in each of the terminals 30, the fixed portion 38 extends outward in the Y-direction from the held portion 34 (see FIG. 5). Referring to FIG. 1, when the connector 10 is used, each of the fixed portions 38 is fixed to and electrically connected with the circuit board 80 via soldering, etc.

Referring to FIG. 3, the structure and the arrangement of the terminals 30 are not limited to the present embodiment but can be variously modified. For example, the number of the terminals 30 is not limited to six. The portion that holds the terminals 30 is not limited to the holding portion 248 of the outer wall 24. Each of the terminals 30 does not need to be the signal terminal. Moreover, the housing 20 may have any structure, provide that the receiving portion 22 is formed.

Figure 7:
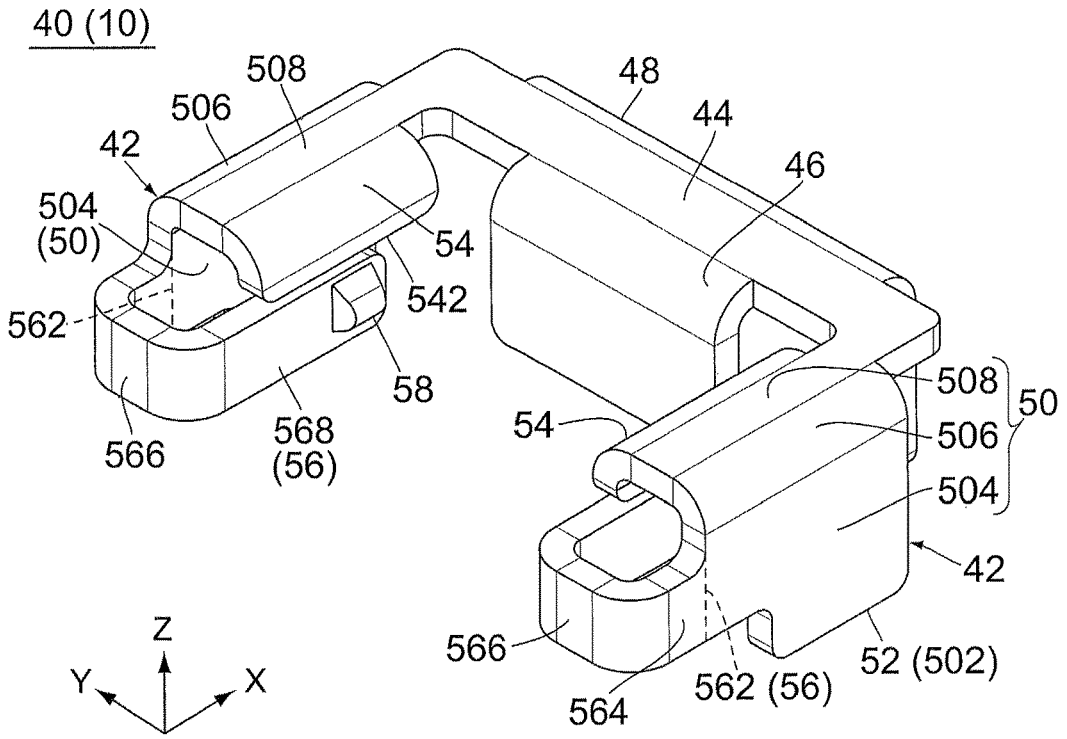
FIG. 7 is a perspective view showing the additional member of the connector of FIG. 1, wherein a position of a starting portion of each of spring portions is illustrated in dashed-line.

Referring to FIG. 7, in the present embodiment, each of the additional members 40 is a single metal plate with bends. Referring to FIGS. 1 to 5, the two additional members 40 have shapes and sizes same as each other. The two additional members 40 are held by the housing 20. The two additional members 40 are apart from each other in the X-direction and arranged in mirror symmetry with respect to the YZ-plane. However, the present invention is not limited thereto. For example, the number of the additional member 40 may be one. The additional members 40 may have shapes different from each other to some extent. Each of the additional members 40 may be formed of a plurality of members which are joined together. However, when a plurality of the additional members 40 are provided, from a view point of reducing manufacture cost, the additional members 40 are preferred to have shapes and sizes same as one another, and each of the additional members 40 is preferred to be formed by bending a single metal plate.

Hereafter, further explanation will be made mainly about the structure, the arrangement in the connector 10 and the function of the front additional member 40, or one of the two additional members 40 that is located at the positive X-side of the connector 10. As described above, the two additional members 40 are the same components as each other. Therefore, the following explanation about the front additional member 40 is applicable, by reversing the situation in the X-direction, to the rear additional member 40, or a remaining one of the two additional members 40 that is located at the negative X-side of the connector 10.

Referring to FIGS. 7 to 12, the additional member 40 has a mirror-symmetrical shape with respect to the XZ-plane. In detail, the additional member 40 has two body portions 42, a coupling portion 44 and two interposing portions 46 and 48. The two body portions 42 are apart from each other in the Y-direction and have shapes mirror-symmetrical to each other with respect to the XZ-plane. The coupling portion 44 extends along the Y-direction as a whole. The coupling portion 44 has opposite ends in the Y-direction which extend rearward, or in the negative X-direction, to be connected to the two body portions 42, respectively.

Each of the interposing portions 46 and 48 is located at the middle part of the coupling portion 44 in the Y-direction. The interposing portion 46 is bent to extend rearward and downward, or in the negative Z-direction, from the coupling portion 44, and subsequently extends downward. The interposing portion 48 is bent to extend forward and downward from the coupling portion 44 and subsequently extends downward.

Referring to FIG. 5, the additional member 40 is embedded in the housing 20 via insert-molding. The coupling portion 44 of the thus-embedded additional member 40 is embedded in an upper end of the coupling wall 244 of the outer wall 24, and the two interposing portions 46 and 48 of the additional member 40 are embedded in the coupling wall 244 so as to interpose the coupling wall 244 in the X-direction. The two body portions 42 are partially embedded in the two sidewalls 242, respectively. The thus-embedded two body portions 42 are located across the receiving portion 22 in the Y-direction.

As described above, the additional member 40 of the present embodiment is attached to the housing 20 via insert-molding. However, the present invention is not limited thereto. For example, the additional member 40 may be press-fit into the housing 20. In this case, the additional member 40 may be attached to the sidewalls 242 and the coupling wall 244 from above. Moreover, the additional member 40 may have only one of the body portions 42. In this case, the connector 10 may comprise a necessary number of the additional members 40 each of which consists of the body portion 42.

As shown in FIGS. 7 to 12, each of the body portions 42 has a base portion 50, a fixed portion 52, an armor portion 54, a spring portion 56 and a projection 58. Therefore, the additional member 40 has the two base portions 50, the two fixed portions 52, the two armor portions 54, the two spring portions 56 and the two projections 58.

Figure 8:
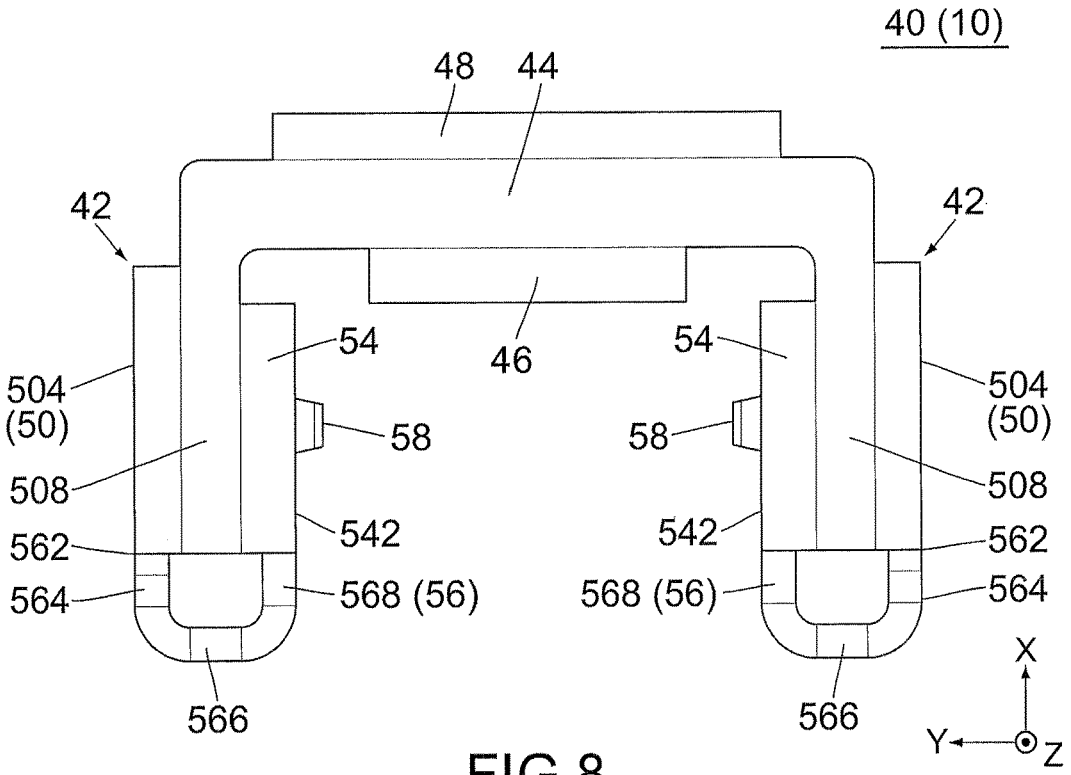
FIG. 8 is a plan view showing the additional member of FIG. 6.
Figure 9:
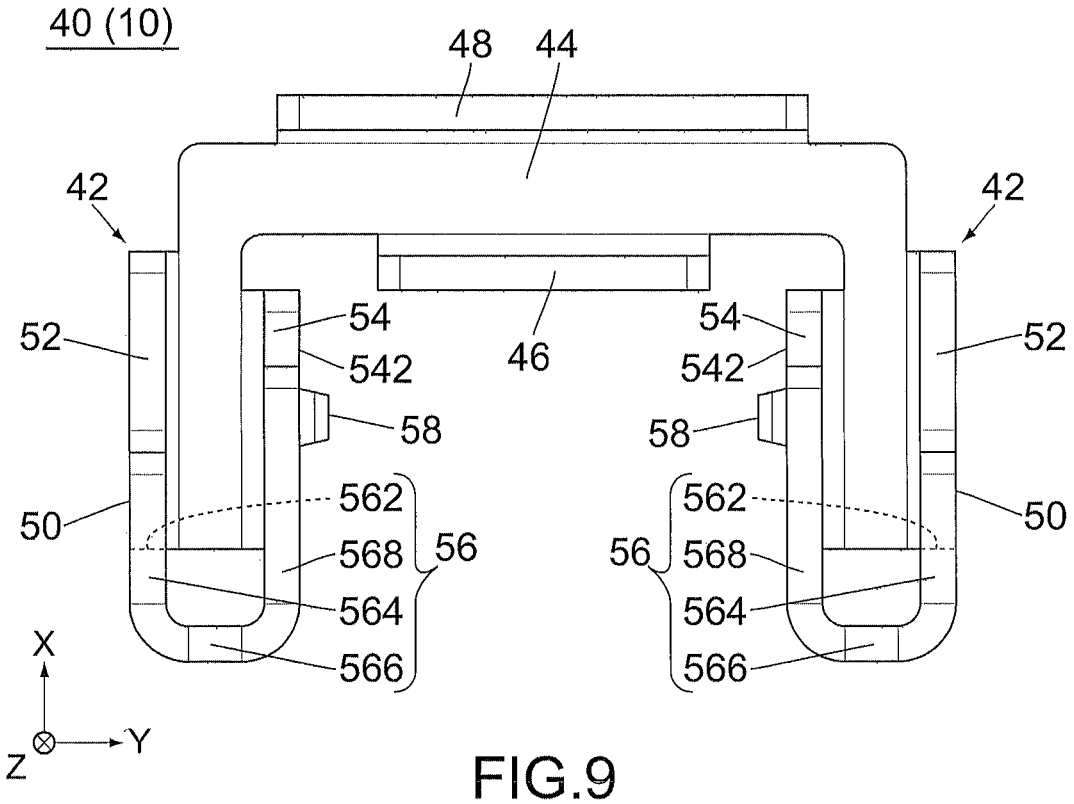
FIG. 9 is a bottom view showing the additional member of FIG. 6, wherein a position of the starting portion of each of the spring portions is illustrated in dashed-line.

As shown in FIGS. 7 to 9, the coupling portion 44 couples the two body portions 42 to each other. The coupling portion 44 of the present embodiment couples the base portions 50 of the two body portions 42 to each other. However, the present invention is not limited thereto. For example, the coupling portion 44 may couple the armor portions 54 of the two body portions 42 to each other.

Figure 10:
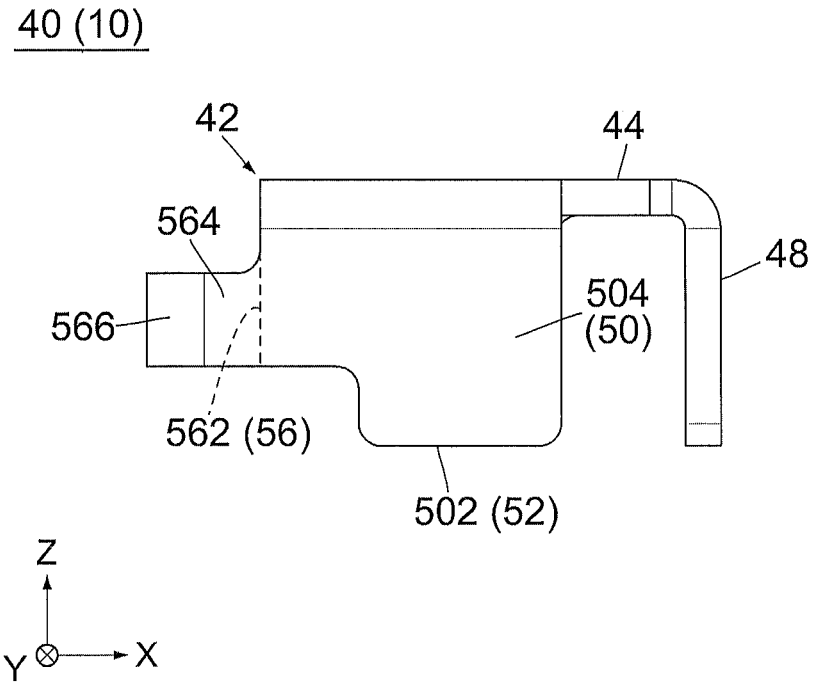
FIG. 10 is a side view showing the additional member of FIG. 6, wherein a position of the starting portion of the spring portion is illustrated in dashed-line.
Figure 11:
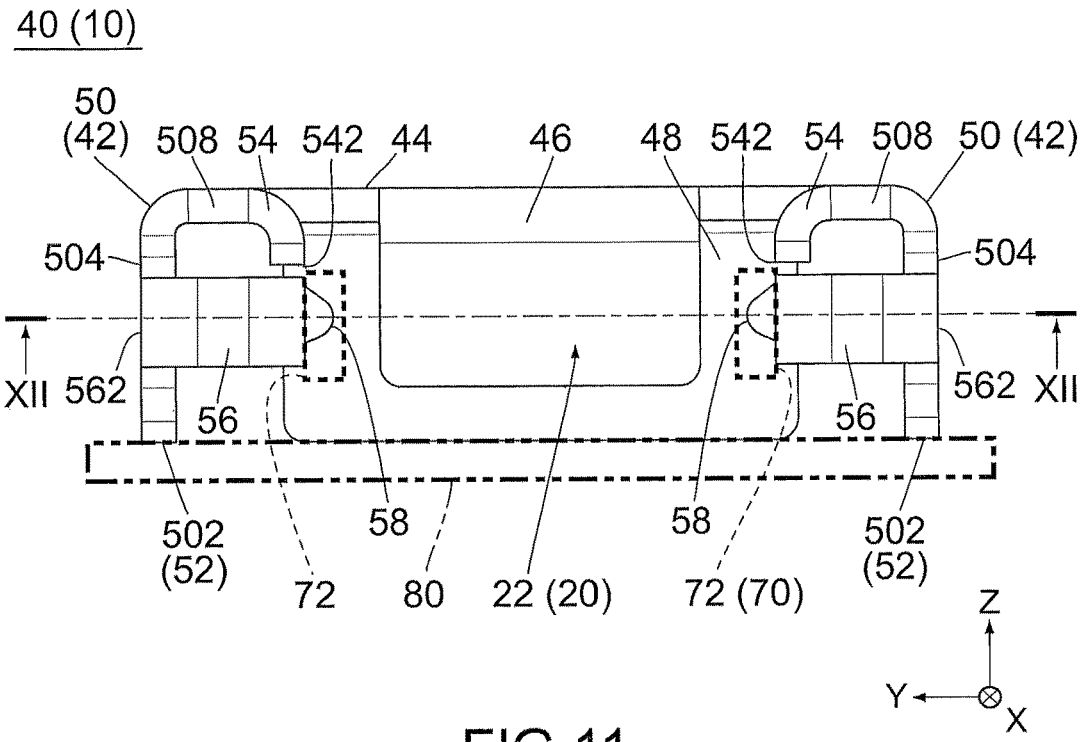
FIG. 11 is a rear view showing the additional member of FIG. 6, wherein an outline of each of mating contact portions of the mating connector is illustrated in dashed-line, and another outline of the circuit board is illustrated in two-dot chain line.
Figure 12:
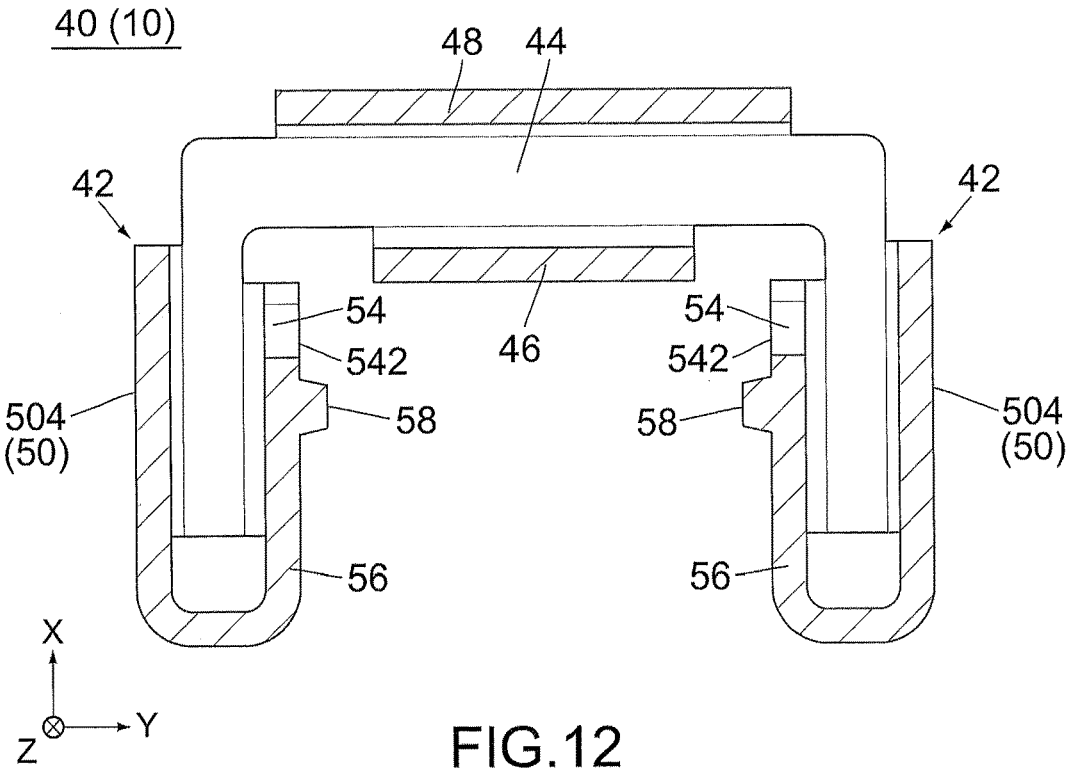
FIG. 12 is a cross-sectional view showing the additional member of FIG. 11, taken along line XII-XII.

Referring to FIGS. 7, 10 and 11, the fixed portion 52 of the present embodiment is a lower surface of the body portion 42 and extends along the X-direction. Referring to FIG. 1, in the Z-direction, the fixed portion 52 is located at a position same as that of the lower surface 20L of the housing 20 which is the lower end of the connector 10. When the connector 10 is used, the fixed portion 52 is fixed to and electrically connected with the circuit board 80 via soldering, etc.

Referring to FIGS. 7, 10 and 11, the base portion 50 extends upward as a whole from the fixed portion 52. In the present embodiment, the fixed portion 52 itself is a boundary portion 502 between the base portion 50 and the fixed portion 52. The base portion 50 according to the present embodiment has a flat-plate portion 504, a bent portion 506 and an upper plate 508. The flat-plate portion 504 has a flat-plate shape in parallel to the XZ-plane and extends straight upward from the fixed portion 52. The flat-Plate portion 504 has an upper part, or the positive Z-side part, which protrudes rearward. The bent portion 506 is bent to extend upward and inward in the Y-direction from the upper end of the flat-plate portion 504. The upper plate 508 has a flat-plate shape in parallel to the XY-plane and extends inward in the Y-direction from the bent portion 506.

Referring to FIGS. 7, 8 and 11, the armor portion 54 extends inward in the Y-direction from the inner end of the upper plate 508 of the base portion 50 in the Y-direction. In detail, as shown in FIG. 11, the armor portion 54 is bent to extend downward and inward in the Y-direction. In other words, the armor portion 54 extends toward the receiving portion 22. The thus-extending armor portion 54 has an innermost portion 542. The innermost portion 542 is a part of the armor portion 54 that is located to be innermost in the Y-direction.

In the present embodiment, the innermost portion 542 of the armor portion 54 is the end of the armor portion 54. However, the present invention is not limited thereto. For example, the armor portion 54 may have an end which is bent to extend toward the flat-plate portion 504 of the base portion 50. In this case, the innermost portion 542 of the armor portion 54 is located inward in the Y-direction relative to the end of the armor portion 54.

Referring to FIGS. 7 to 10, the spring portion 56 extends from the base portion 50 and supported by the base portion 50 to be resiliently deformable. In other words, the spring portion 56 is resiliently deformable relative to a support point, or a boundary portion (starting portion) 562 between the spring portion 56 and the base portion 50.

The spring portion 56 according to the present embodiment has a first spring 564, a second spring 566 and a third spring 568 in addition to the starting portion 562. The first spring 564 extends rearward along the X-direction from the starting portion 562. The second spring 566 is bent to extend rearward and inward in the Y-direction from a rear end, or the negative X-side end, of the first spring 564, subsequently extends inward in the Y-direction, and is subsequently bent to extend forward and inward in the Y-direction. The third spring 568 extends forward along the X-direction from a front end, or the positive X-side end, of the inner part of the second spring 566 in the Y-direction while passing under the armor portion 54.

The thus-shaped spring portion 56 according to the present embodiment has a J-like shape in the XY-plane and has high spring properties. In particular, the third spring 568 extends long along the X-direction to have high spring properties. However, the present invention is not limited thereto, but the structure of the spring portion 56 can be variously modified. For example, the position of the starting portion 562 in the X-direction may be shifted forward so that the first spring 564 has a length almost equal to another length of the third spring 568. In this case, the spring portion 56 has a U-like shape in the XY-plane.

Referring to FIGS. 7, 9 and 11, the projection 58 is supported by the spring portion 56. In detail, the projection 58 is formed in the vicinity of the front end of the third spring 568 of the spring portion 56 and projects inward in the Y-direction.

Referring to FIG. 8, when the additional member 40 is seen from above along the Z-direction, the third spring 568 of the spring portion 56 is partially covered by the armor portion 54. In particular, the third spring 568 according to the present embodiment has a part that is located at a position same as that of the armor portion 54 in the X-direction and that is entirely covered by the armor portion 54. However, the present invention is not limited thereto, but the spring portion 56 may be, at least in part, covered by the armor portion 54. For example, the armor portion 54 may be formed to extend rearward and to cover the whole of the third spring 568 of the spring portion 56. Instead, the spring portion 56 may be formed to extend inward in the Y-direction from the middle part of the base portion 50 in the X-direction so that the whole of the spring portion 56 is covered by the armor portion 54.

Figure 6:
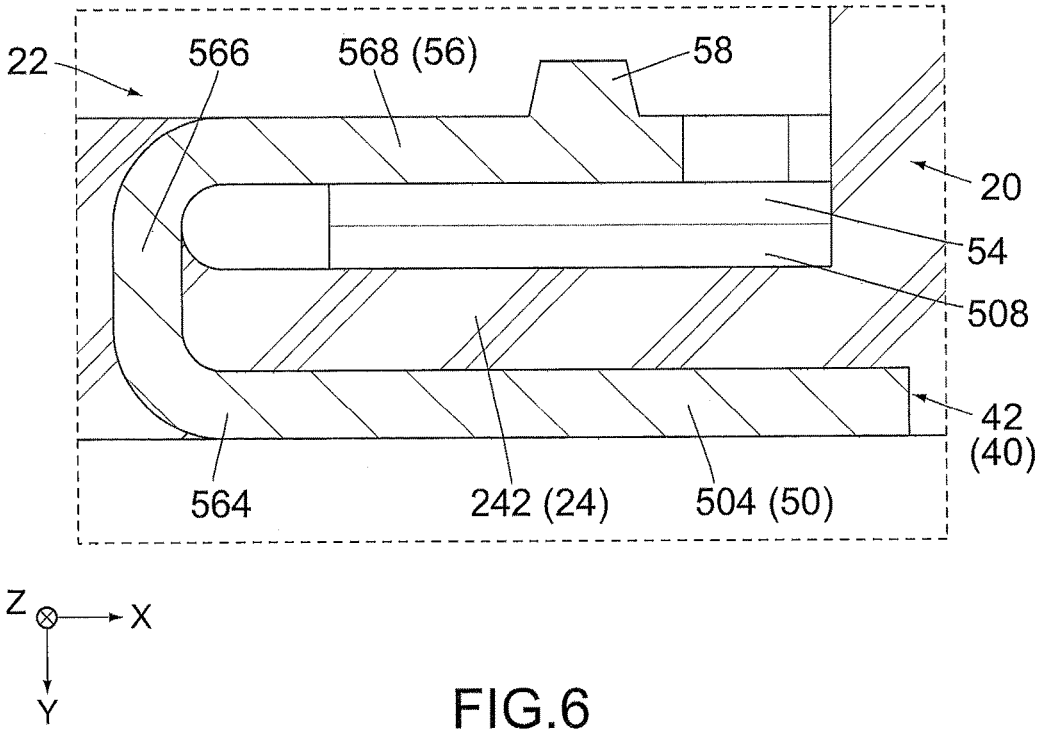
FIG. 6 is an enlarged, cross-sectional view showing a body portion of an additional member of the connector and therearound (part enclosed by dashed line A) of FIG. 5.

Referring to FIG. 6, the base portion 50 is embedded in the sidewall 242 of the housing 20 except a part of the upper plate 508 and a part in the vicinity of the lower end thereof so that the base portion 50 is fixed to the housing 20. In addition, the first spring 564 and the second spring 566 of the spring portion 56 are embedded in the sidewall 242 to be fixed to the housing 20. In contrast, the third spring 568 of the spring portion 56 is located in a space formed in the sidewall 242 and is movable relative to the housing 20. Therefore, the projection 58 supported by the third spring 568 is movable in the Y-direction.

As described above, the first spring 564 and the second spring 566 of the present embodiment are embedded in the housing 20 and unmovable relative to the housing 20. However, the present invention is not limited thereto. One or both of the first spring 564 and the second spring 566 may have no part embedded in the housing 20 to be movable relative to the housing 20.

Referring to FIGS. 3 and 5, the base portion 50 is located outside the receiving portion 22 in the Y-direction. Moreover, when the additional member 40 is seen from above along the Z-direction under an unmated state where the connector 10 is not mated with the mating connector 70, the projection 58 is, at least in part, located in the receiving portion 22 to be visible. The thus-arranged projection 58 is pressed against and brought into contact with the mating connector 70 under the mated state.

Referring to FIG. 11, the projection 58 of the present embodiment is brought into contact with a mating contact portion 72 of the mating connector 70 under the mated state. For example, the mating contact portion 72 is a mating power terminal. In this case, the projection 58 is a contact portion of a power terminal of the connector 10 and is brought into electrical contact with the mating contact portion 72 under the mated state. However, the present invention is not limited thereto. For example, the mating connector 70 may have a mating engaged portion (not shown) instead of the mating contact portion 72. In this case, the projection 58 is an engaged portion of the connector 10 that is engaged with the mating engaged portion under the mated state and locks the mated state. As described above, the connector 10 is connected to the mating connector 70 at the projection 58 supported by the spring portion 56.

According to the present embodiment, the whole of the projection 58 is located in the receiving portion 22 to be visible. However, the present invention is not limited thereto. The projection 58 may be, at least in part, located in the receiving portion 22 to be visible.

Referring to FIG. 3, according to the present embodiment, each of the body portions 42 of the additional member 40 is provided with the armor portion 54 which is bent to extend downward. As previously described, the armor portion 54 covers the third spring 568 (see FIG. 7), which is movable relative to the housing 20, from above. Therefore, during the mating process of the connector 10 with the mating connector 70, the mating connector 70 is guided by the armor portion 54 to be smoothly moved downward without deforming the third spring 568 prior to the contact of the mating connector 70 with the projection 58.

Referring to FIG. 6, in each of the body portions 42 of the additional member 40, all of the parts except the armor portion 54 and the third spring 568 are fixed to the housing 20, so that only the armor portion 54 and the third spring 568 are movable relative to the housing 20. In addition, the armor portion 54 and the third spring 568 are not directly connected to each other. Therefore, even if the mating connector 70 is brought into abutment with the armor portion 54 in the mating process of the connector 10 with the mating connector 70 so that the armor portion 54 receives a relatively small pushing force that resiliently deforms the armor portion 54, the third spring 568 is unaffected by this pushing force. The projection 58 supported by the third spring 568 is not moved by this pushing force but is brought into contact with the mating contact portion 72 (see FIG. 11) as designed.

Referring to FIG. 3 together with FIG. 11, the pushing force of the mating connector 70, which is applied to the armor portion 54 of the additional member 40, is received by the circuit board 80 via the base portion 50 and the fixed portion 52. Therefore, even in a case where the pushing force is so large that the armor portion 54 is plastically deformed, a part of the additional member 40 that is close to the fixed portion 52 is hardly affected by the pushing force.

Figure 13:
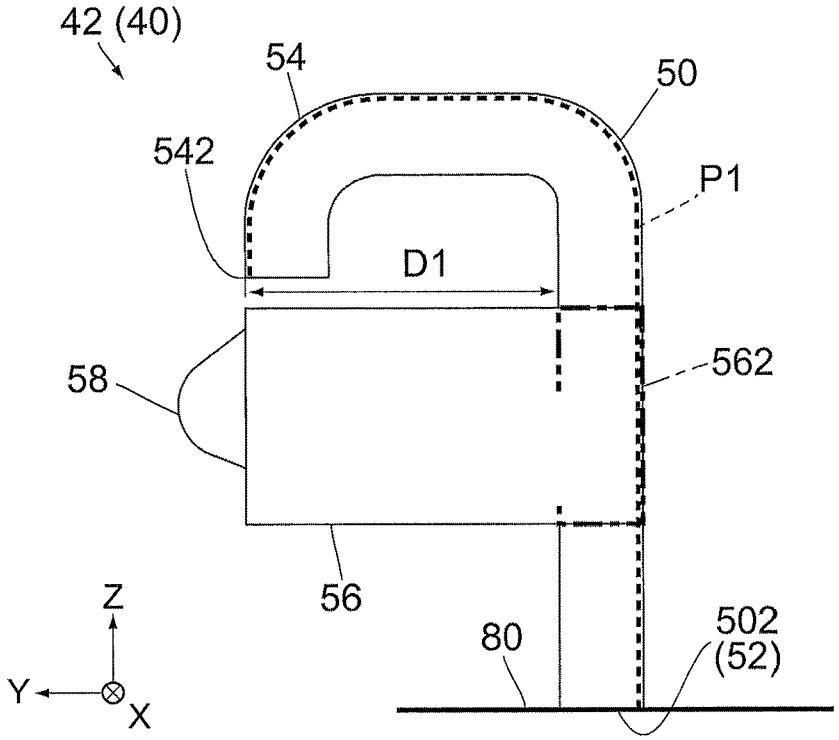
FIG. 13 is a rear view showing a positional relation among portions of the body portion of the additional member of FIG. 11, wherein dashed line shows a path along which a base portion and an armor portion extend, and chain dotted line shows an outline of the starting portion of the spring portion.

Referring to FIG. 13, the spring portion 56 extends from the aforementioned part that is hardly affected by the pushing force. More specifically, the spring portion 56 has the starting portion 562 at which the spring portion 56 starts to extend from the base portion 50 and which is nearer to the fixed portion 52 than to the innermost portion 542 of the armor portion 54. According to this arrangement, the starting portion 562, which is close to the fixed portion 52, is hardly moved even if the armor portion 54 is pushed by the mating connector 70 to be resiliently or plastically deformed. Therefore, the spring portion 56 extending from the starting portion 562 and the projection 58 supported by the spring portion 56 are hardly moved. According to the connector 10 (see FIG. 3) of the present embodiment, connection reliability of the projection 58 to the mating connector 70 (see FIG. 3) can be improved.

In the additional member 40 of the present embodiment, a position of the starting portion 562 of the spring portion 56 in the Y-direction is equal to another position of the fixed portion 52 in the Y-direction. In other words, a distance D0 (see FIG. 15) between the starting portion 562 and the fixed portion 52 in the Y-direction is zero. In contrast, the innermost portion 542 of the armor portion 54 is apart from the starting portion 562 by a distance D1 in the Y-direction. Thus, in the Y-direction, the distance D0 (see FIG. 15) between the starting portion 562 and the fixed portion 52 is smaller than the distance D1 between the starting portion 562 and the innermost portion 542. In other words, the starting portion 562 is nearer to the fixed portion 52 than to the innermost portion 542 in the Y-direction. According to the present embodiment, this arrangement facilitates to reduce the influence of the aforementioned pushing force on the spring portion 56.

According to the present embodiment, when the starting portion 562, the innermost portion 542 and the fixed portion 52 are seen along the X-direction, an imaginary path P1 can be defined so that the imaginary path P1 extends between the fixed portion 52 and the innermost portion 542 via the starting portion 562. A path length (creeping distance) between the starting portion 562 and the fixed portion 52 along the path P1 is shorter than another path length (creeping distance) between the starting portion 562 and the innermost portion 542 along the path P1. In other words, when the starting portion 562, the innermost portion 542 and the fixed portion 52 are seen along the X-direction, the starting portion 562 is nearer to the fixed portion 52 than to the innermost portion 542 in an extending direction of the base portion 50 and the armor portion 54, or in a direction along the path P1. According to the present embodiment, this arrangement also facilitates to reduce the influence of the aforementioned pushing force on the spring portion 56.

Referring to FIG. 11, in the additional member 40 of the present embodiment, the flat-plate portion 504 of the base portion 50 securely resists the aforementioned downward pushing force because the flat-plate portion 504 is located just above the fixed portion 52. The spring portion 56 is hardly affected by the aforementioned pushing force because the spring portion 56 extends from the flat-plate portion 504. According to the present embodiment, the connection reliability of the projection 58 of the connector 10 to the mating connector 70 can be further improved. However, the spring portion 56 may extend from a part other than the flat-plate portion 504, provided that the spring portion 56 extends from the base portion 50. For example, the spring portion 56 may extend from the bent portion 506.

Figure 14:
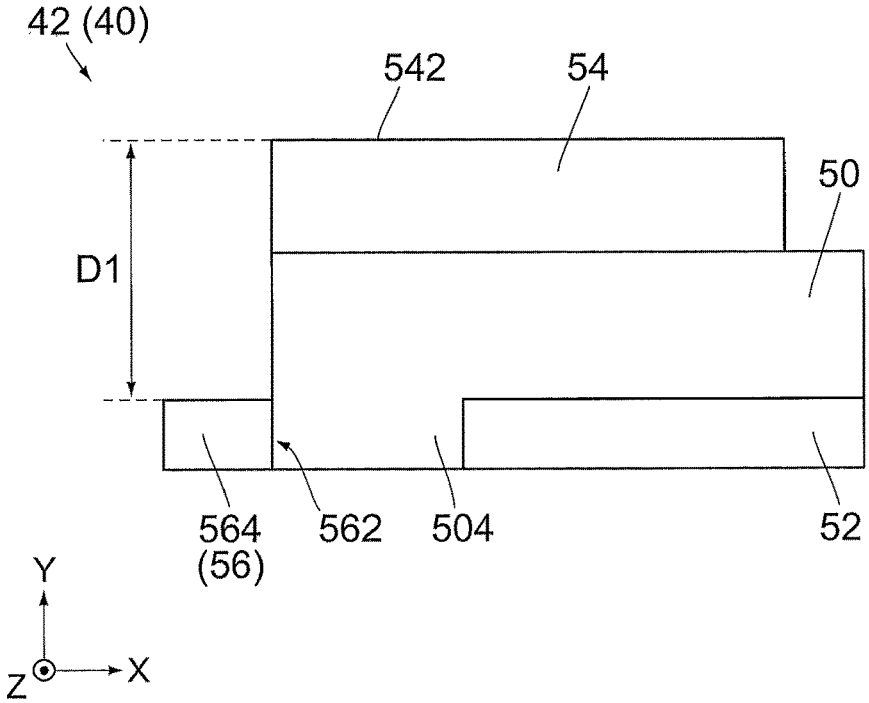
FIG. 14 is a view showing another positional relation among the portions of the body portion of FIG. 13 under a state where the body portion is seen from above, wherein an outline of each of the portions is illustrated by continuous line even in a case where the outline is hidden under the other portion.

Referring to FIG. 14, in the additional member 40 of the present embodiment, a position of the armor portion 54 in the X-direction overlaps with another position of the fixed portion 52 in the X-direction. This arrangement facilitates to more efficiently disperse the aforementioned pushing force to the fixed portion 52. Therefore, the connection reliability of the projection 58 (see FIG. 13) of the connector 10 to the mating connector 70 can be further improved. From a view point of efficient dispersion of the aforementioned pushing force to the fixed portion 52, the position of the armor portion 54 in the X-direction is more preferred to be equal to or included in the position of the fixed portion 52 in the X-direction.

The present embodiment can be further variously modified as described below in addition to the already explained modifications.

Referring to FIG. 6, In the additional member 40 of the present embodiment, the flat-plate portion 504 of the base portion 50 and the first spring 564 form an outer portion that is located outward in the Y-direction. The third spring 568 of the spring portion 56 and the outer portion interpose a predetermined part of the sidewall 242 of the housing 20 therebetween to be located at opposite sides of the sidewall 242 in the Y-direction, respectively. However, this predetermined part, or a part of the sidewall 242, does not need to be provided. In other words, the third spring 568 may faces the outer portion in the Y-direction. Moreover, the body portion 42 does not need to be embedded in the housing 20.

Referring to FIG. 7, in the additional member 40, the first spring 564 and the second spring 566 of the spring portion 56 may be formed to extend downward so that each of the first spring 564 and the second spring 566 has a lower end which is located at a position same as that of the fixed portion 52. The lower ends of the thus-extending first spring 564 and second spring 566 may be fixed to the circuit board 80 (see. FIG. 1) via soldering, etc. According to this structure, the first spring 564 and the second spring 566 lose their spring properties when the connector 10 is used while the spring portion 56, or the third spring 568, can be more securely prevented from being moved downward. Thus, the contact reliability of the projection 58 of the connector 10 to the mating connector 70 can be further securely improved.

Figure 15:
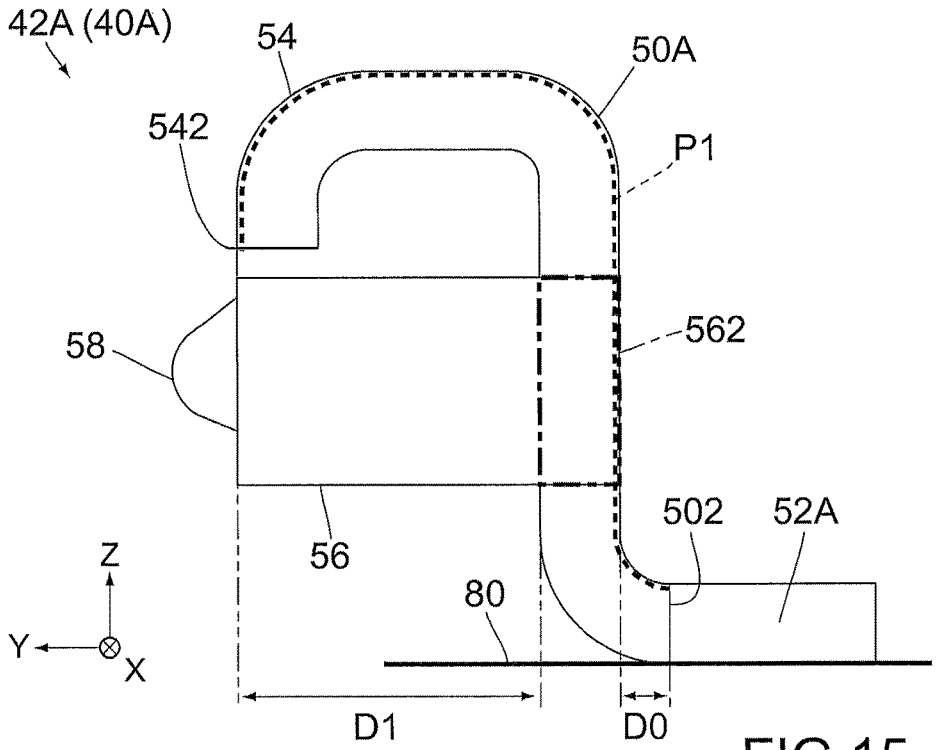
FIG. 15 is a rear view showing a modification of the positional relation of FIG. 13.
Figure 16:
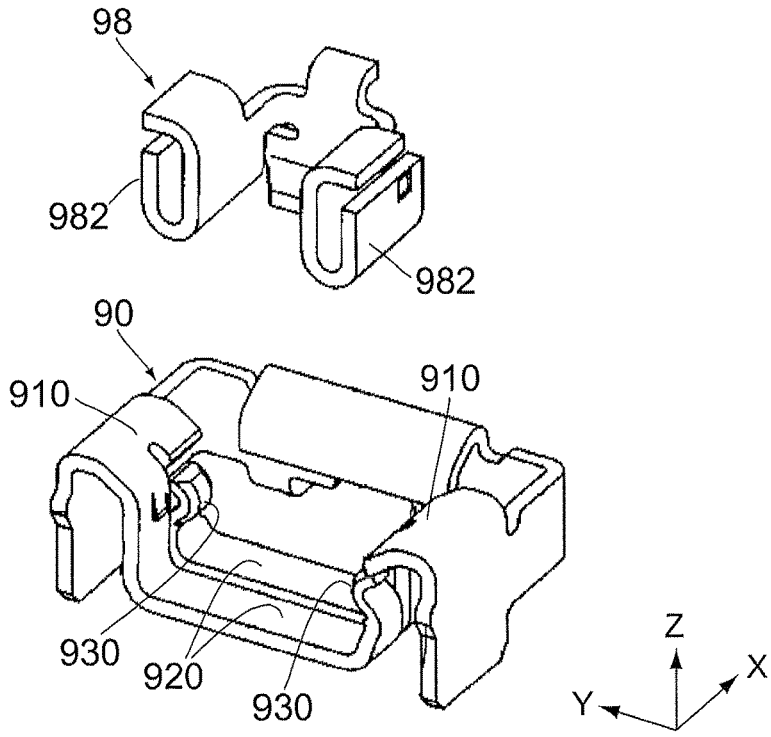
FIG.16 PRIOR ART
FIG. 16 is a perspective view showing a power terminal of Patent Document 1.

Referring to FIG. 15 together with FIG. 13, an additional member 40A according to a modification has a body portion 42A which is different from the body portion 42 of the additional member 40. The body portion 42A has a base portion 50A and a fixed portion 52A different from the base portion 50 and the fixed portion 52, respectively. However, the body portion 42A has a structure same as that of the body portion 42 except the aforementioned difference. The base portion 50A has a part that is located in the vicinity of a lower end thereof and that is bent to extend outward in the Y-direction. The fixed portion 52A extends outward in the Y-direction from the boundary portion 502 which is an outer end of the base portion 50A in the Y-direction.

The spring portion 56 of the present modification also has the starting portion 562 at which the spring portion 56 starts to extend from the base portion 50A and which is nearer to the fixed portion 52A than to the innermost portion 542 of the armor portion 54, In detail, in the Y-direction, the distance D0 between the starting portion 562 and the boundary portion 502 provided to the fixed portion 52A is smaller than the distance D1 between the starting portion 562 and the innermost portion 542. Moreover, when the starting portion 562, the innermost portion 542 and the fixed portion 52A are seen along the X-direction, a creeping distance, or a distance along the path P1, between the starting portion 562 and the fixed portion 52A is smaller than another creeping distance between the starting portion 562 and the innermost portion 542. Referring to FIG. 3, according to the present modification, the contact reliability of the projection 58 of the connector 10 to the mating connector 70 can be also improved.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mountable on an object in an upper-lower direction and mateable with a mating connector along the upper-lower direction, wherein:

the connector comprises a housing, terminals and an additional member;

the terminals and the additional member are held by the housing;

the housing has a receiving portion;

the receiving portion partially receives the mating connector under a mated state where the connector is mated with the mating connector;

the additional member has a fixed portion, a base portion, an armor portion, a spring portion and a projection;

the fixed portion is fixed to the object when the connector is used;

the base portion extends upward from the fixed portion and is located outside the receiving portion in a lateral direction perpendicular to the upper-lower direction;

the armor portion extends inward from the base portion in the lateral direction;

the spring portion extends from the base portion;

the projection is supported by the spring portion and projects inward in the lateral direction;

when the additional member is seen from above along the upper-lower direction, the spring portion is, at least in part, covered by the armor portion, and the projection is, at least in part, located in the receiving portion to be visible; and the spring portion has a starting portion at which the spring portion starts to extend from the base portion and which is nearer to the fixed portion than to an innermost part of the armor portion that is located to be innermost in the lateral direction.

2. The connector as recited in claim 1, wherein the spring portion has a U-like or J-like shape in a plane perpendicular to the upper-lower direction.

3. The connector as recited in claim 1, wherein:

the base portion has a flat-plate portion of a flat-plate shape; and the spring portion extends from the flat-plate portion.

4. The connector as recited in claim 1, wherein the projection is pressed against and brought into contact with the mating connector under the mated state.

5. The connector as recited in claim 1, wherein a position of the armor portion in a front-rear direction perpendicular to both the upper-lower direction and the lateral direction is equal to or overlaps with another position of the fixed portion in the front-rear direction.

6. The connector as recited in claim 1, wherein:

the additional member has two body portions each of which has the fixed portion, the base portion, the armor portion, the spring portion and the projection; and the two body portions are located across the receiving portion in the lateral direction.

7. The connector as recited in claim 6, wherein:

the additional member has a coupling portion; and the coupling portion couples the base portions of the two body portions or the armor portions of the two body portions to each other.

* * * * *